US008141403B2

(12) United States Patent
Gemignani et al.

(10) Patent No.: US 8,141,403 B2
(45) Date of Patent: Mar. 27, 2012

(54) METHOD FOR BENDING PIPES, RODS, PROFILED SECTIONS AND SIMILAR BLANKS, AND CORRESPONDING DEVICE

(75) Inventors: Roberto Gemignani, Cantu' (IT); Matteo Strano, Cassino (IT)

(73) Assignee: BLM S.p.A., Cantu', Como (IT)

( * ) Notice: Subject to any disclaimer, the term of this patent is extended or adjusted under 35 U.S.C. 154(b) by 408 days.

(21) Appl. No.: 12/466,190

(22) Filed: May 14, 2009

(65) Prior Publication Data

US 2009/0288465 A1 Nov. 26, 2009

(30) Foreign Application Priority Data

May 21, 2008 (EP) ..... 08425360

(51) Int. Cl.
*B21D 7/02* (2006.01)

(52) U.S. Cl. ..... 72/215; 72/369

(58) Field of Classification Search ..... 72/166, 72/176, 149, 152–154, 157, 158, 214–218, 72/362, 369
See application file for complete search history.

(56) References Cited

U.S. PATENT DOCUMENTS 4,249,407 A 2/1981 Fogleman
4,464,923 A * 8/1984 Boggs et al. ..... 72/307
5,111,675 A 5/1992 Murata
5,632,176 A 5/1997 Bhandari
2002/0104361 A1 8/2002 Broggi et al.

FOREIGN PATENT DOCUMENTS

EP 0 757 925 A1 2/1997
EP 1 226 887 A1 7/2002

* cited by examiner

*Primary Examiner* — Mark Rosenbaum
(74) *Attorney, Agent, or Firm* — Merchant & Gould P.C.

(57) ABSTRACT

A method urges a blank along an axial direction between a movable bending tool and a stationary counter-tool and, while the blank is being moved forwards, of moving the bending tool from a neutral position, in which the blank is not bent, to a working position, in which the blank is bent to the desired bending centerline radius, the working position being rotated with respect to the neutral position by a given angle of rotation depending on the desired bending centerline radius. The method further includes urging the blank between a pair of shoes upstream of the bending tool so as to make the deformation of the blank easier, and the step of moving the bending tool from the neutral position to the working position is carried out by controlling at least two degrees of freedom of the movement of the bending tool in the plane defined by the axial direction and by a transverse direction perpendicular to the axial direction. By virtue of the initial deformation of axial and radial compression of the blank due to the passage between the shoes, the following bending step by the bending tool is made easier and allows for obtaining bending centerline radiuses significantly smaller than the smallest ones obtainable with the traditional variable-radius bending methods.

17 Claims, 6 Drawing Sheets

FIG.8
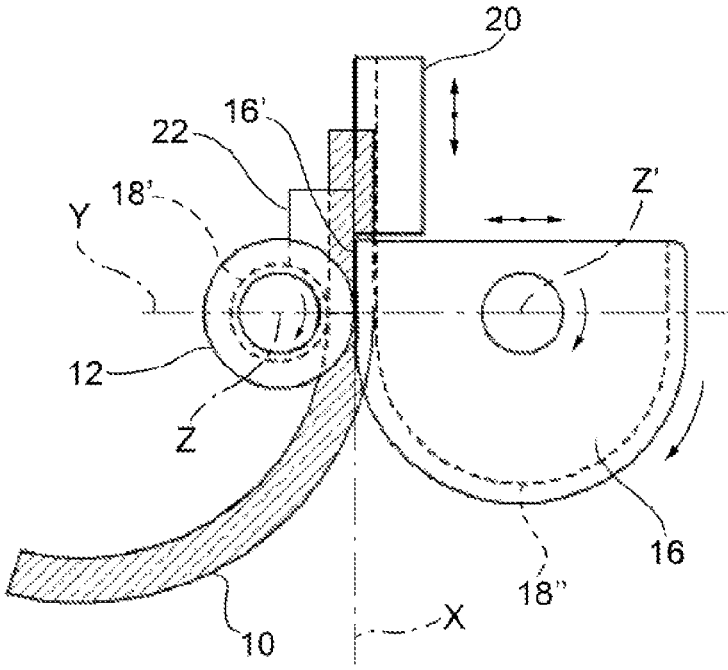
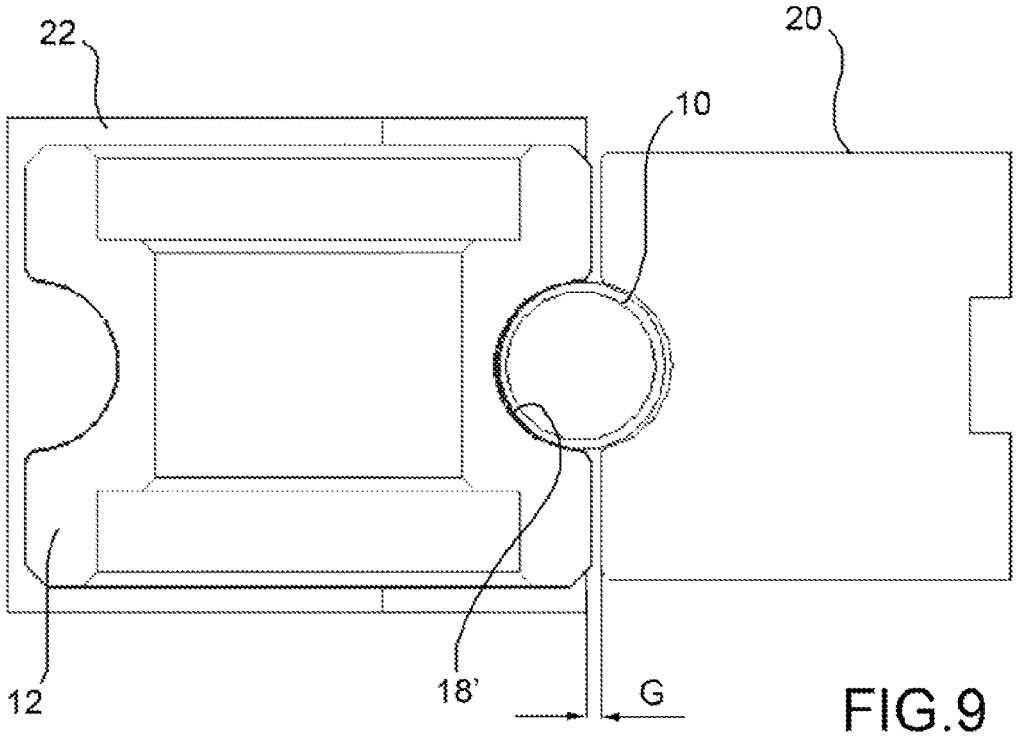
FIG.9

METHOD FOR BENDING PIPES, RODS, PROFILED SECTIONS AND SIMILAR BLANKS, AND CORRESPONDING DEVICE

This application claims benefit of Serial No. 08425360.8, filed 21 May 2008 in Europe and which application is incorporated herein by reference. To the extent appropriate, a claim of priority is made to the above disclosed application.

BACKGROUND OF THE INVENTION

The present invention relates to a method for bending pipes, rods, profiled sections and similar blanks.

According to a further aspect, the present invention relates to a device for bending pipes, rods, profiled sections and similar blanks.

The expression "method for bending pipes, rods, profiled sections and similar blanks" is to be intended as referred to the set of technological operations of plastic deformation of the blank in question, which are required to change the course of the axis thereof from a straight one to a curvilinear one according to a continuous or discontinuous path, by applying simple or composite mechanical stresses onto the blank and by properly constraining the blank itself. In the remaining part of the description, reference will be made for convenience's sake to the bending of pipes, although the invention is clearly applicable to the bending of any other similar blank, be it a bar, a profiled section etc.

The known bending methods differ from each other substantially in the way of applying the deformation forces or torques, and in the way of constraining the pipe, usually by means of bending tools (dies) suitably sized and shaped. The characteristic parameters of the bending method are the size (diameter and thickness) of the pipe, the material of the pipe and the spatial course of the axis of the pipe, which course is defined by the length of the straight portions between adjacent bends, by the bending radiuses and angles and by the relative spatial orientation of the bends. In particular, each bend of the final product of the bending method is defined by the bending radius, or centerline radius, and by the bending angle.

Nowadays, the most commonly used pipe bending methods are the draw bending, the stretch bending and the roll bending (or variable-radius bending).

The draw bending method is schematically illustrated in FIGS. 1A and 1B of the attached drawings and substantially consists in the following two steps:

a) the pipe to be bent, indicated 110, is clamped at its front end between a bending tool or die 112, which is able to rotate around an axis Z perpendicular to the axis X of the pipe 110, and a front clamping block 114 and is guided upstream of the front block 114 by a rear abutment shoe 116 which is usually mounted on a movable slider (not shown) so as to be able to slide along the direction of the axis X of the pipe 110 (hereinafter simply referred to as axial direction) to accompany the axial forward movement of the pipe itself (FIG. 1A); and b) the die 112 is caused to rotate about the axis of rotation Z so as to draw the pipe 110 forwards while winding it around a shaped groove 118 of the die itself which extends along a curve of radius R, while the rear show 116 accompanies the axial forward movement of the pipe 110 and applies on it a reaction force perpendicular to the axial direction X, thereby producing on the pipe 110 a bend having a centerline radius substantially corresponding to the centerline radius R of the groove 118 of the die 112 (FIG. 1B).

The draw bending method is at the moment the most common one and is capable of offering the best results in terms of quality. In particular, this method makes it possible to obtain small centerline radiuses which are small, even smaller than once the diameter of the pipe, and of good quality. On the other hand, it has several limits, such as the fact that it requires to change the die when bends of different centerline radiuses have to be obtained or pipes of different diameters have to be worked, as well as the fact that it requires to use particularly complicated apparatuses to produce a sequence of bends with straight portions of extremely small or even null length interposed therebetween.

The stretch bending method is schematically illustrated in FIGS. 2A and 2B of the attached drawings, where parts and elements identical or corresponding to those of FIGS. 1A and 1B have been given the same reference numerals, and substantially consists in the following two steps:

a) the pipe 110 to be bent is clamped at its rear end by means of rear clamping blocks 114 so as to project forwards with respect to a stationary die 112 having a shaped groove 118 extending along a curvilinear path of centerline radius R, the pipe 110 being pressed against the groove by means of a bending shoe 116 capable of rotating around an axis of rotation Z which is perpendicular to the axis X of the pipe 110 and passes through the centre of curvature of the groove 118 (FIG. 2A); and b) the bending shoe 116 is caused to rotate around the axis of rotation Z, thereby winding the pipe 110 onto the die 112 and producing on the pipe itself a bend having a centerline radius substantially corresponding to the centerline radius R of the groove 118 of the die 112 (FIG. 2B).

Therefore, the two known bending methods described above suffer both from the shortcoming of making it possible to obtain only bends of fixed centerline radius, that is, a centerline radius corresponding to that of the shaped groove of the die. In order to obtain bends with a different centerline radius, it is therefore necessary to change die and accordingly to stop the process. Accordingly, when the pipe must have a complex path with a plurality of bends of different centerline radiuses, a plurality of die changes, and hence a corresponding plurality of stops of the process, are necessary, which results in a significant increase in the duration of the work cycle. This results in a higher cost of the process, and hence of the final product. Moreover, in order to make it possible to change automatically tools having different centerline radiuses to reduce the duration of the tool-change downtimes, the machines have to be provided with special handling devices and are thus more complicated and expensive.

The roll bending method, or variable-radius bending method, is schematically illustrated in FIGS. 3A to 3C of the attached drawings, where parts and elements identical or corresponding to those of the preceding figures have been given the same reference numerals, and substantially consists in the following steps:

a) the pipe 110 to be bent is clamped at its rear end by a chuck 114 mounted on a chuck-carrying slider (not shown) which can slide in the direction X of the axis of the pipe 110 (FIG. 3A);

b) the pipe 110 is urged forwards by the chuck 114 through a stationary roller 112 acting as a die, which has a shaped groove 118 and is mounted so as to be able to rotate freely around an axis of rotation Z perpendicular to the axis X of the pipe 110, and a bending roller 116, mounted so as to be able to rotate freely around an axis of rotation Z' perpendicular to the axis X of the pipe 110 and to rotate around the axis of rotation Z of the stationary roller 112 from a neutral position (illustrated in dashed line in FIG. 3A), in which the pipe 110 is not deformed, to a working position rotated with respect to the neutral position by an angle of rotation $\alpha$ which varies depending on the bending centerline radius of the bend to be obtained (illustrated in continuous line in FIG. 3A), in which position the pipe 110 is bent to the desired radius, the pipe 110 being also pressed by abutment rollers 120 which exert on the pipe a reaction force perpendicular to the axial direction X.

The bend thus obtained may comprise the following three zones depending on the desired result and on the bend immediately preceding or following the one in question:

- a leading zone 110' which is obtained during the movement (rotation) of the bending roller 116 from the neutral position to the working position while the pipe 110 is urged forwards by the chuck 114 (FIG. 3A);
- an intermediate zone 110" which has the desired centerline radius and is obtained by keeping the bending roller 116 still in the working position and causing the pipe 110 to move forwards by means of the chuck 114 (FIG. 3B); and
- a trailing zone 110''' which is obtained during the movement (rotation) of the bending roller 116 from the working position to the neutral position while the pipe 110 continues to be urged forwards by the chuck 114 (FIG. 3C).

The chuck 114 may also be provided with a rotational movement around the axis X of the pipe 110 in order to obtain 3-D bends, in particular bends with a spiral course.

The roll bending method offers the advantage of making it possible to obtain bends with different centerline radiuses without having to stop the process to change die. On the other hand, it also has some limits, such as for example the fact that the length of the straight portions between two adjacent bends cannot be bought to zero, the fact that the results (in terms of final centerline radius of the pipe) cannot be perfectly repeated with varying mechanical characteristics of the material of the pipe under working, the difficulty of foreseeing the results (in terms of final centerline radius of the pipe) depending on the geometry, setting and movement of the bending apparatus, the fact that bends having a bending centerline radius about five times shorter than the diameter of the pipe under working cannot be obtained, and the fact that bends with constant radius from the start to the end cannot be obtained, since the use of the bending roller requires that the start (leading zone) and the end (trailing zone) of the bend have a fillet radius different from the desired bending centerline radius of the bend.

U.S. Pat. No. 5,111,675 discloses a variable-radius bending method in which the pipe is caused to move forwards first through a guide cylinder and then through a die having a bending tool in the form of a sleeve, which is supported so as to be able to swivel around an axis perpendicular to the axis of the pipe. The die is movable along a first direction parallel to the axis of the pipe to change the distance between the guide cylinder and the bending tool, and along a second direction perpendicular to the axis of the pipe to change the distance between the axis of the pipe and the centre of the bending tool. The movement of the die along these two directions makes it possible to adjust the bending centerline radius of the bend produced onto the pipe.

The above-mentioned U.S. Patent further discloses a device for carrying out the variable-radius bending of pipes according to the method briefly discussed above. Such a device suffers however from the shortcoming that it is not able to carry out the bending according to at least two different methods, for example the variable-radius bending method and the draw bending method. Moreover, the sleeve acting as a bending tool must be calibrated on the diameter of the pipe to be worked. A further shortcoming linked to the use of such a device is represented by the fact that the fillet radius between two consecutive bends cannot be eliminated.

SUMMARY OF THE INVENTION

It is an object of the present invention to provide a method for bending pipes, rods, profiled sections and similar blanks, as well as a corresponding bending device, which is able to overcome the shortcomings of the known variable-radius bending methods, in particular the impossibility of obtaining particularly reduced bending centerline radiuses (for example in the order of twice the diameter of the pipe) and the presence of fillet radiuses between consecutive bends, but which offers at the same time the same advantages in terms of flexibility and costs.

This and other objects are fully achieved according to a first aspect of the invention by virtue of a method for bending pipes, rods, profiled sections and similar blanks.

According to a further aspect of the invention, the aforesaid and other objects are fully achieved by virtue of a device for bending pipes, rods, profiled sections and similar blanks.

BRIEF DESCRIPTION OF THE DRAWINGS

Preferred embodiments of the invention will be illustrated now in the detailed description which follows, given purely by way of non-limiting example with reference to the attached drawings, in which:

FIG. 8 is a plan view schematically illustrating the degrees of freedom of the various components of the bending device of FIGS. 4A and 4B; and FIG. 9 is a view on an enlarged scale of the bending device of FIGS. 4A and 4B, sectioned along line IX-IX of FIG. 4A.

DETAILED DESCRIPTION OF THE PREFERRED EMBODIMENTS

Figure 4A:
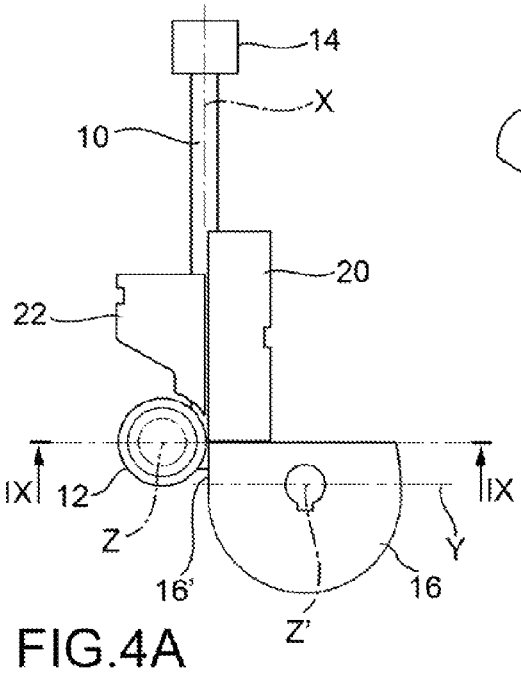
FIGS. 4A and 4B are a plan view and a perspective view, respectively, which schematically illustrate a device for bending pipes, rods, profiled sections and similar blanks according to a preferred embodiment of the present invention, at the beginning of the pipe bending operation.
Figure 4B:
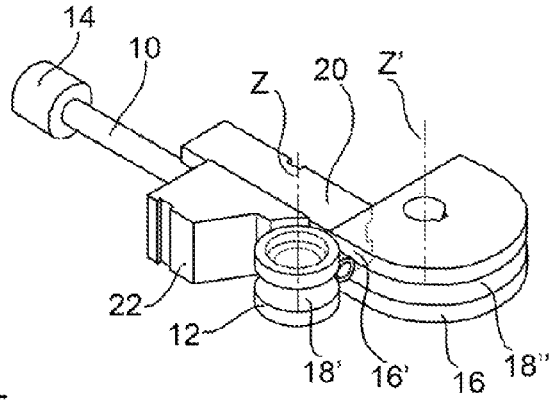
Figure 5A:
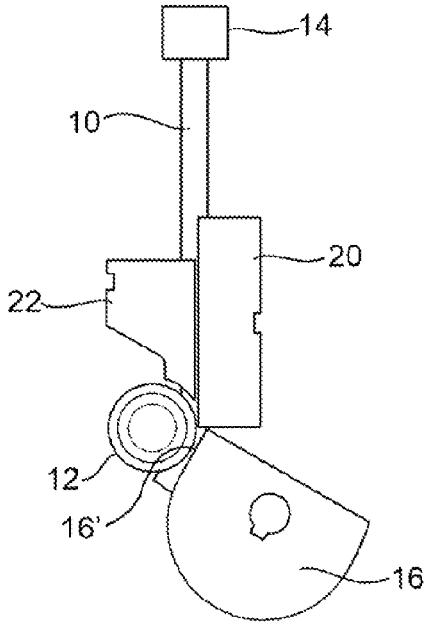
FIGS. 5A and 5B are a plan view and a perspective view, respectively, which schematically illustrate the bending device of FIGS. 4A and 4B when the pipe is being deformed by extrusion.
Figure 5B:
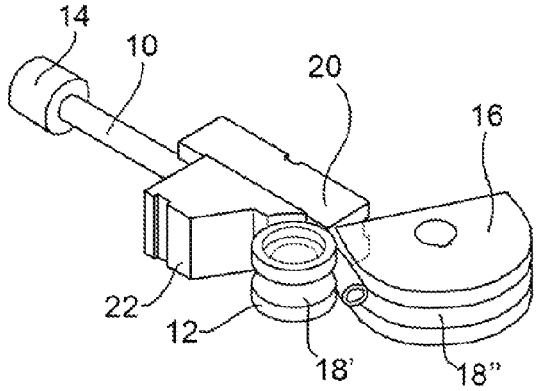
Figure 6A:
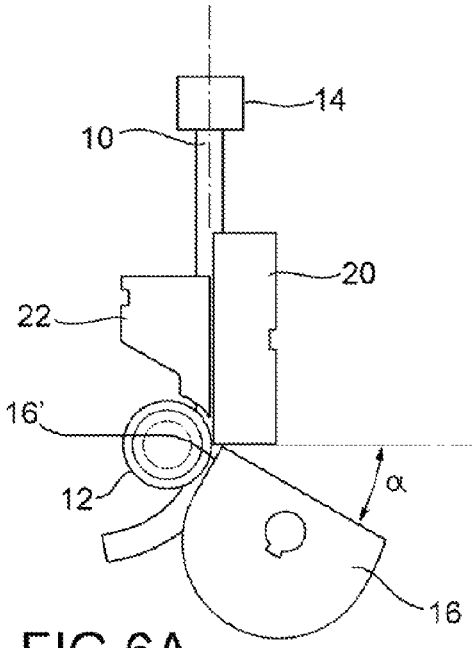
FIGS. 6A and 6B are a plan view and a perspective view, respectively, which schematically illustrate the bending device of FIGS. 4A and 4B when the pipe is deformed by roll bending.
Figure 6B:
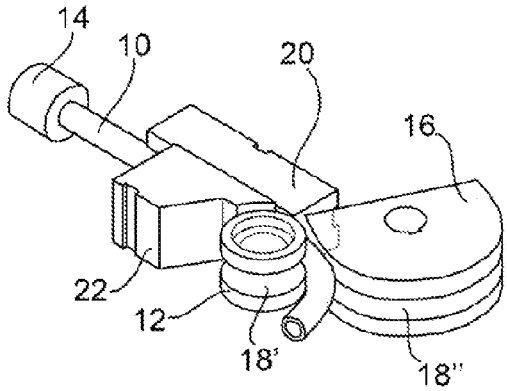
Figure 7A:
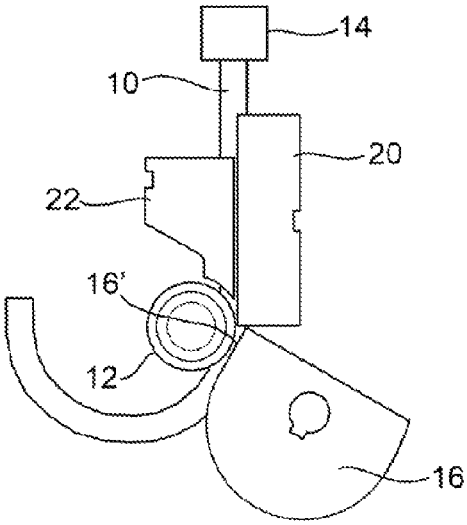
FIGS. 7A and 7B are a plan view and a perspective view, respectively, which schematically illustrate the bending device of FIGS. 4A and 4B at the end of the bending operation.
Figure 7B:
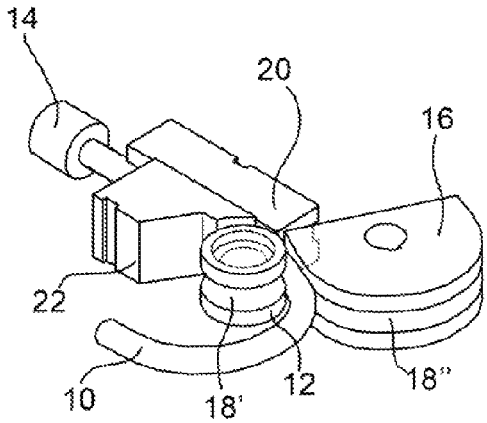

With reference to FIGS. 4A to 9, in order to carry out a method for bending a pipe 10 or a similar blank a device according to the invention is used which basically comprises a chuck 14, a die 12 in the form of a roller having on its lateral surface a shaped groove 18' (which can be seen better in the sectioned view of FIG. 9), a bending tool 16 having a working portion 16' which extends along a straight direction (which in the position illustrated in FIG. 4A is oriented parallel to the axis of the pipe 10, indicated X) and has a shaped groove 18" on its lateral surface, and a pair of shoes 20 and 22.

The degrees of freedom of the above-mentioned components of the bending device are shown in FIG. 8. More specifically, the chuck 14 is mounted on a chuck-carrying slider (not shown) so as to be able to slide in the direction X of the axis of the pipe 10 to urge the pipe 10 first through the two shoes 20 and 22 and then through the die 12 and the bending tool 16. The die 12 is mounted so as to be freely rotatable around its own axis, which is indicated Z and is perpendicular to the axis X of the pipe 10. The bending tool 16 is able to rotate around an axis of rotation Z' perpendicular to the axis X of the pipe 10, to rotate about the axis of rotation Z of the die 12 from a neutral position (FIGS. 4A and 4B) to a working position rotated with respect to the neutral position by an angle of rotation $\alpha$ which depends on the bending centerline radius of the bend to be obtained (FIGS. 5A to 7B), and to translate along a direction Y perpendicular to the axis X of the pipe 10 to change its distance from the die 12. In other words, the bending tool 16 has two translational degrees of freedom in the plane defined by the two axes X and Y, i.e. the plane perpendicular to the axis Z', in addition to the rotational degree of freedom around its own axis Z'. The shoe 20 is able to translate parallel to the axis X of the pipe 10 to accompany the forward movement of the pipe towards the die 12 and the bending tool 16, whereas the shoe 22 is stationary. The angle of rotation $\alpha$ and the position of the centre of instant rotation of the bending tool 16 both depends nonlinearly on the desired bending centerline radius and are established so as to maximize the predictability and the repeatability of the centerline radius obtained.

The method for bending the pipe 10 is carried out as follows.

First of all (FIGS. 5A and 5B) the pipe 10 is urged by the chuck 14 first through the two shoes 20 and 22 and then through the die 12 and the bending tool 16, while this latter is properly moved in the plane XY by rotation both around its own axis Z' and around the axis Z of the die 12 and by simultaneous translation along the axis Y. In particular, the bending tool 16 is moved so as to ensure the condition of tangency in the point of contact between the surface of the working portion 16' and the pipe 10 with the desired centerline radius, i.e. so as to cause the axis Z' of the bending tool 16 to move along a circular path around the bending centre of the pipe 10. During this phase, the movable shoe 20 may be moved forwards along with the pipe 10 at the same speed or at a different speed.

As shown in FIG. 9, the two shoes 20 and 22 are separated by a gap G which varies depending on the dimensional and shape errors of the pipe 10 under working, and are urged towards each other with a given clamping force so as to radially compress the pipe 10 and thus make the deformation of the pipe itself easier.

Thereafter (FIGS. 6A, 6B, 7A and 7B), the bending tool 16 is stopped in a given position depending on the desired bending centerline radius, while the pipe 10 continues to be urged forwards by the chuck 14 and hence to be deformed by the bending tool 16 according to a curved course having a constant radius equal to the set centerline radius.

The method is carried out in such a manner that the pipe 10 under working is constantly in a stress state mainly of axial compression. Due to this stress state, the pipe undergoes a sort of "extrusion" which allows to make the deformation of the pipe itself easier.

Figure 1A:
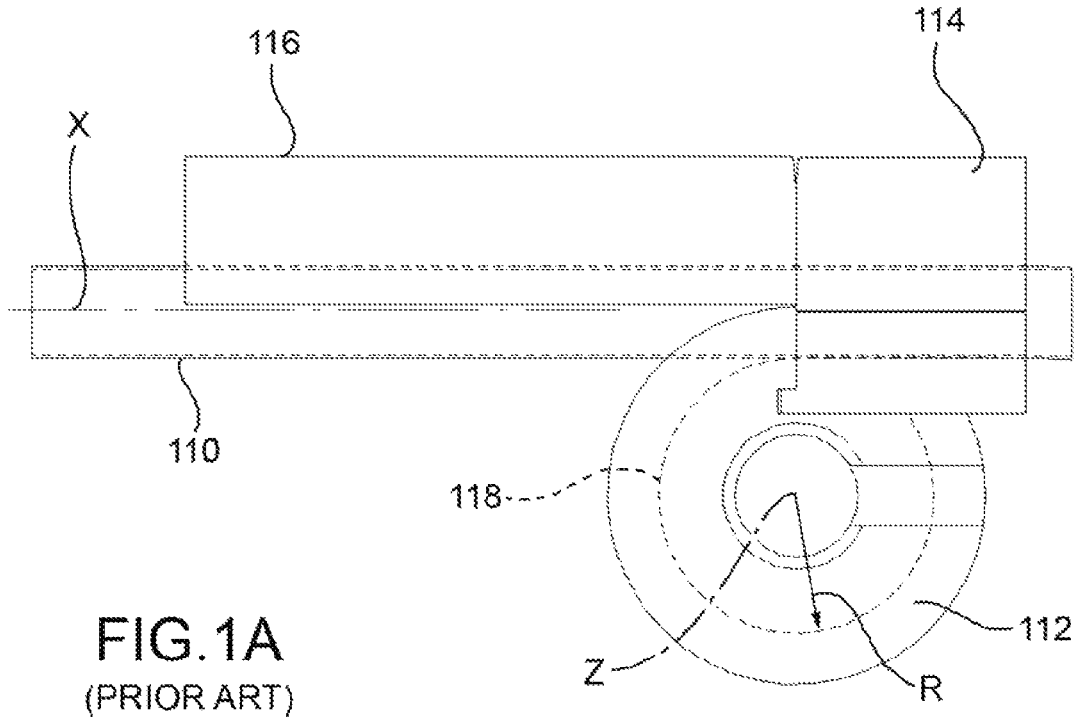
FIG.1A (PRIOR ART)
FIGS. 1A and 1B schematically show a device for bending pipes according to the draw bending method, at the beginning and at the end of the bending operation, respectively.
Figure 1B:
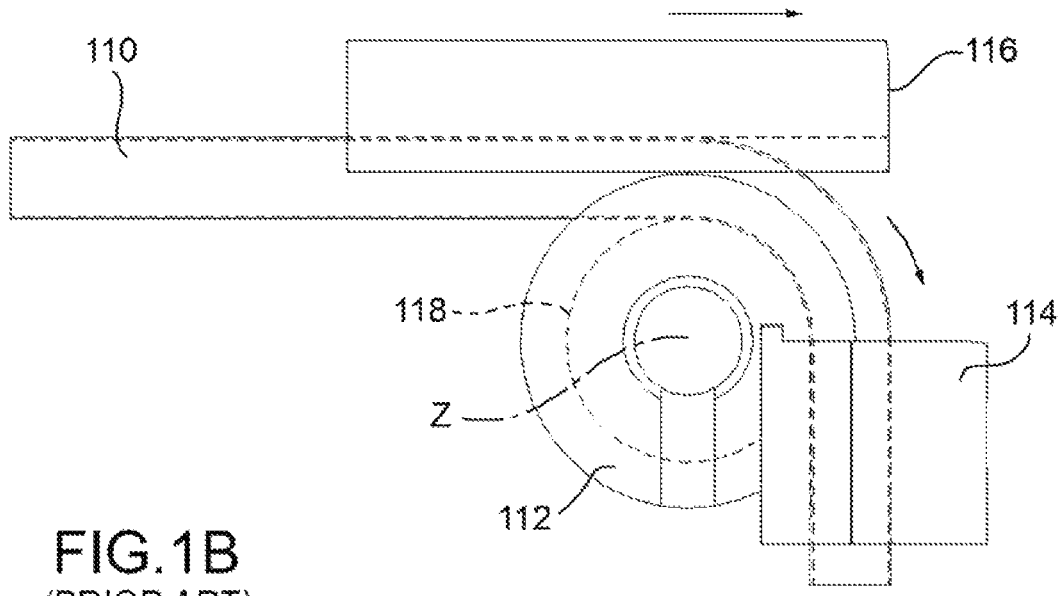
FIG.1B (PRIOR ART)
Figure 2A:
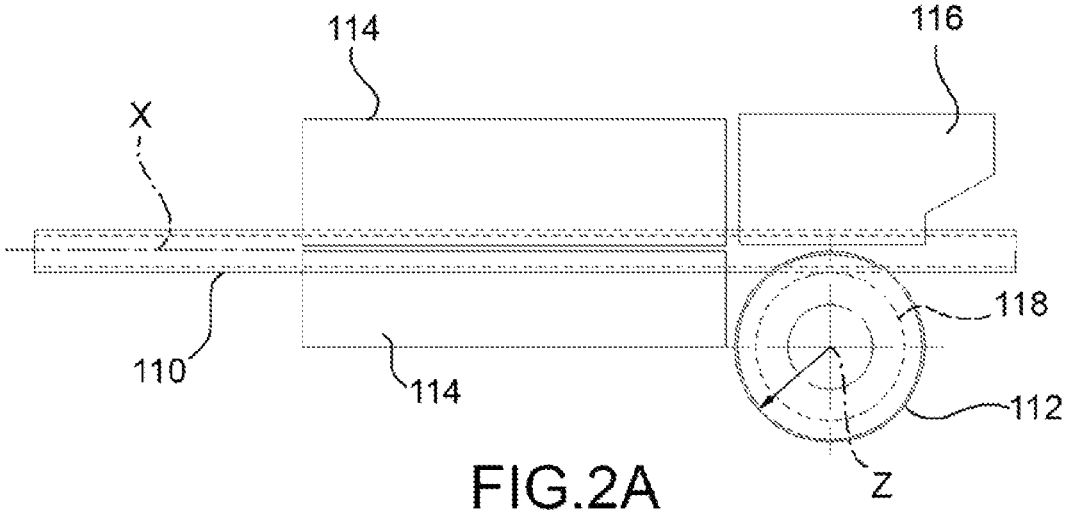
FIG.2A (PRIOR ART)
FIGS. 2A and 2B schematically show a device for bending pipes according to the stretch bending method, at the beginning and at the end of the bending phase, respectively.
Figure 2B:
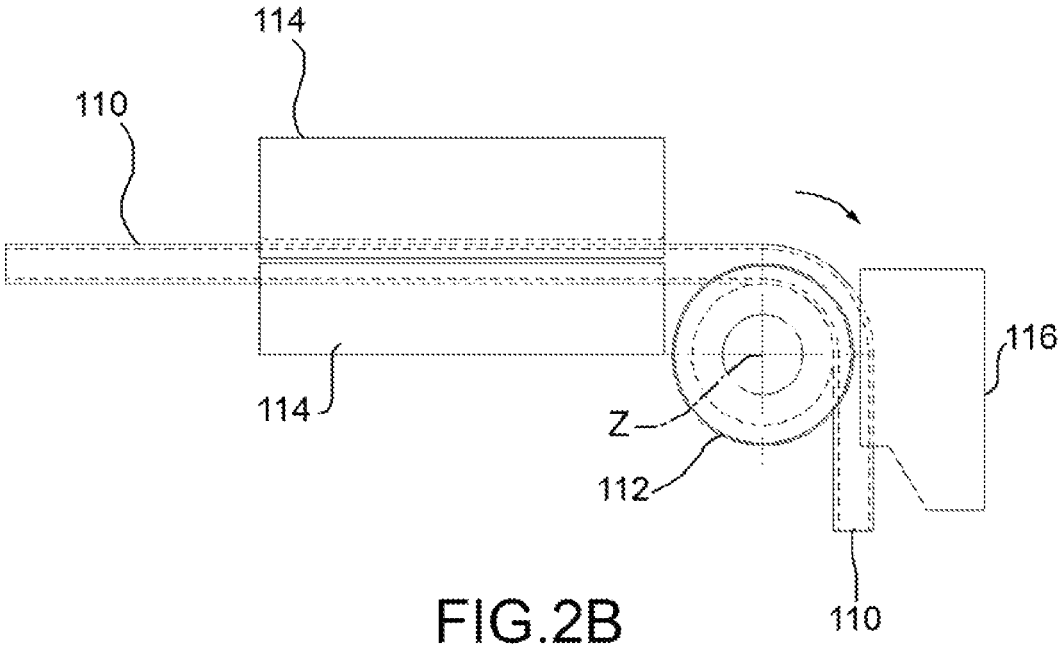
FIG.2B (PRIOR ART)
Figure 3A:
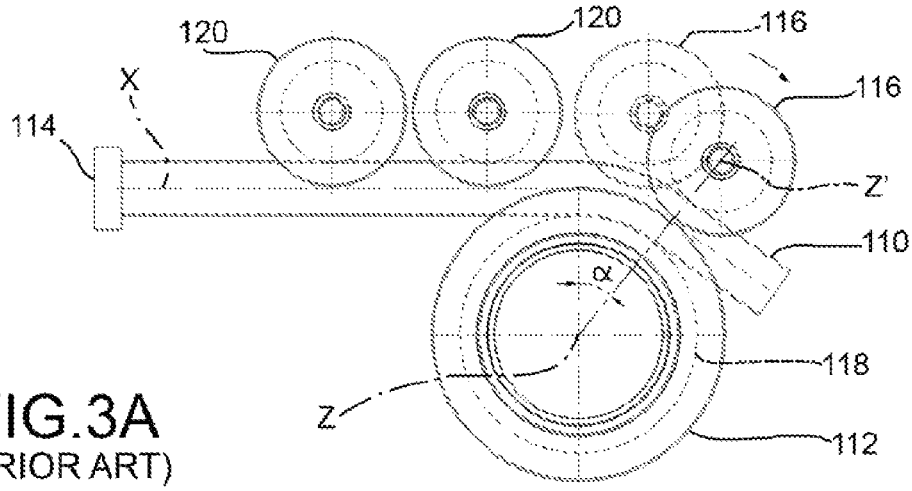
FIG.3A (PRIOR ART)
FIGS. 3A to 3C schematically show a device for bending pipes according to the variable-radius bending method (roll bending), when the leading zone of the bend is being obtained, when the intermediate zone of the bend is being obtained and at the end of the bending operation, respectively.
Figure 3B:
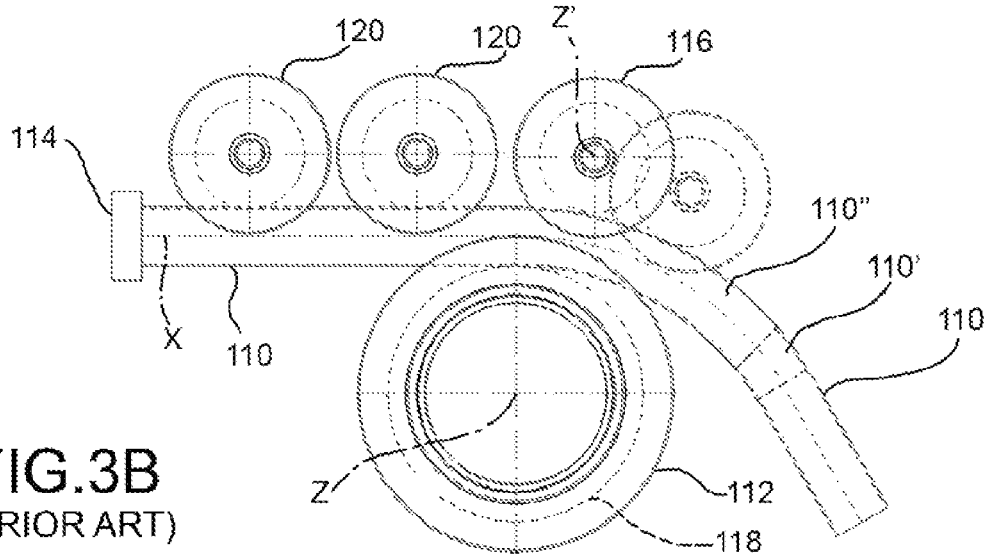
FIG.3B (PRIOR ART)
Figure 3C:
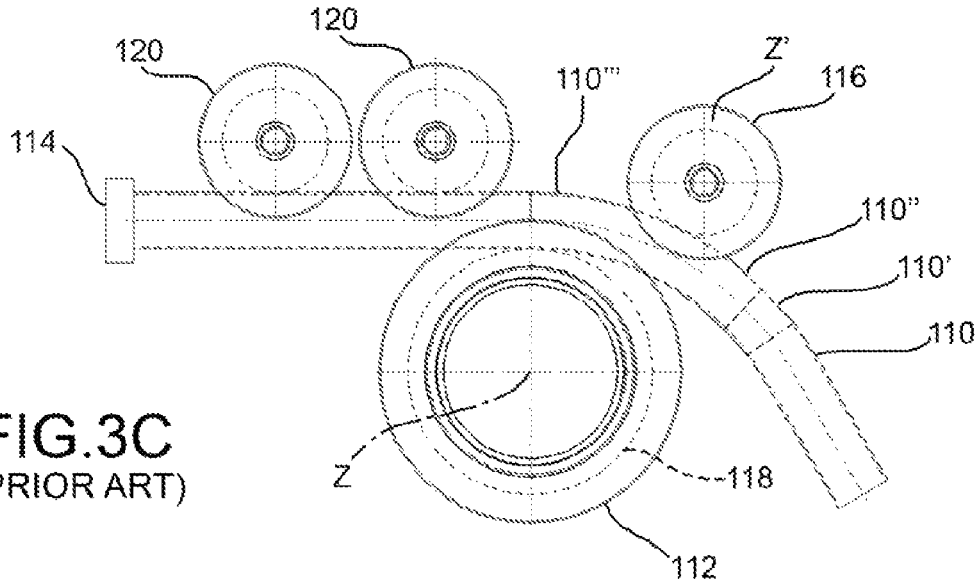
FIG.3C (PRIOR ART)

The bending method according to the invention makes it possible:

- to obtain bending centerline radiuses equal to or even smaller than twice the diameter of the pipe, hence considerably smaller than those which can be obtained with the known variable-radius bending methods;
- to keep the thickness of the pipe on the extrados close to the nominal value, thereby avoiding the reduction of thickness occurring in the draw bending method and in the stretch bending method, since the method according to the invention does not stress the extrados of the pipe under traction but under compression;
- to reduce the leading and trailing zones having a "false radius", i.e. a radius different from the desired centerline radius (zones 110' and 110''' of the bend obtained with the roll bending method illustrated in FIGS. 3A to 3C);
- to reduce the straight portion required between each bend and the next one; and
- to obtain more predictable and repeatable results.

Naturally, the principle of the invention remaining unchanged, the embodiments and constructional details may vary widely with respect to those described and illustrated purely by way of non-limiting example.

For example, the bending tool 16 might be provided with a further degree of freedom of translation in the direction Z' of its own axis, i.e. perpendicularly to the bending plane, in order to make it possible to control also the deformation of the pipe in the direction perpendicular to the bending plane, i.e. to obtain a 3-D bending.

Moreover, a core might be used which is inserted into the pipe to be bent in order to support the inner walls of the pipe itself.

What is claimed is:

1. Method for bending an elongated blank, comprising:

urging the blank along an axial direction between a movable bending tool and a counter-tool, while the blank is being moved forwards, moving the bending tool from a neutral position, in which the blank is not bent, to a working position, in which the blank is bent to the desired bending centerline radius, the working position being rotated with respect to the neutral position by a given angle of rotation depending on the desired bending centerline radius, and urging the blank between a pair of shoes upstream of the bending tool so as to make the deformation of the blank easier, wherein the step of moving the bending tool from the neutral position to the working position is carried out by controlling at least two degrees of freedom of the movement of the bending tool in a plane defined by the axial direction and by a transverse direction perpendicular to the axial direction.

2. Method according to claim 1, wherein the blank is urged towards the shoes and towards the bending tool by a clamp that clamps the rear end of the blank.

3. Method according to claim 1, wherein the shoes are separated by a gap and are urged towards each other in a direction perpendicular to the axial direction with a given clamping force to compress radially the blank.

4. Method according to claim 1, wherein one of the shoes is moved forwards in the same way and direction as the blank while the blank is urged between the shoes.

5. Method according to claim 1, wherein the counter-tool is an idler roller having an axis perpendicular to the axial direction.

6. Method according to claim 1, wherein the step of moving the bending tool from the neutral position to the working position is carried out by causing the bending tool to rotate around an axis thereof perpendicular to the plane, by causing the axis of the bending tool to rotate around a stationary axis parallel thereto and by causing the bending tool to translate in the transverse direction.

7. Method according to claim 6, wherein the counter-tool is an idler roller having an axis perpendicular to the axial direction and wherein said stationary axis is coaxial with the axis of the idler roller.

8. Method according to claim 1, wherein the step of moving the bending tool from the neutral position to the working position is carried out by causing the bending tool to rotate around an axis thereof perpendicular to the plane, and by causing the bending tool to translate both in the axial direction and in the transverse direction.

9. Method according to claim 1, further comprising the step of inserting a core within the blank.

10. Device for bending an elongated blank, comprising:

a movable bending tool arranged to be moved from a neutral position, in which the blank is not bent, and a working position, in which the blank is bent to the desired bending centerline radius, the working position being rotated with respect to the neutral position by a given angle of rotation depending on the desired bending centerline radius, a counter-tool, urging means arranged to urge the blank towards the bending tool and the counter-tool, a pair of shoes located upstream of the bending tool and arranged to be urged towards each other with a given clamping force so as to compress radially the blank being urged therethrough and hence to cause the blank to plasticize, and driving means arranged to move the bending tool from the neutral position to the working position by controlling at least two degrees of freedom thereof in a plane defined by the axial direction and by a transverse direction perpendicular to the axial direction.

11. Device according to claim 10, wherein said urging means are arranged to clamp the rear end of the blank.

12. Device according to claim 10, wherein the shoes are separated by a gap and are arranged to be urged towards each other in a direction perpendicular to the axial direction.

13. Device according to claim 10, wherein one of the shoes is translatable in the axial direction.

14. Device according to claim 10, wherein the counter-tool is an idler roller having an axis perpendicular to the axial direction.

15. Device according to claim 10, wherein said driving means are arranged to cause the bending tool to rotate around an axis thereof perpendicular to the plane, to cause the axis of the bending tool to rotate around a stationary axis parallel thereto and to cause the bending tool to translate in the transverse direction.

16. Device according to claim 15, wherein the counter-tool is an idler roller having an axis perpendicular to the axial direction and wherein said stationary axis is coaxial with the axis of the idler roller.

17. Device according to claim 10, wherein said driving means are arranged to cause the bending tool to rotate around an axis thereof perpendicular to the plane and to cause the bending tool to translate both in the axial direction and in the transverse direction.

* * * * *